United States Patent [19]
Heck
[11] 4,318,258
[45] Mar. 9, 1982

[54] THERMAL INSULATION FOR BUILDINGS

[76] Inventor: Friedrich Heck, Heckenpfad 15, 6702 Bad Dürkheim, Fed. Rep. of Germany

[21] Appl. No.: 20,508

[22] Filed: Mar. 14, 1979

[51] Int. Cl.[3] ..... E04F 13/04; E04C 2/20; E04B 1/80

[52] U.S. Cl. ..... 52/309.12; 52/453; 52/743; 428/159

[58] Field of Search ..... 52/309.12, 309.8, 453, 52/743; 428/163, 192

[56] References Cited

U.S. PATENT DOCUMENTS 4,044,520 8/1977 Barrows ..... 52/309.12
4,191,001 3/1980 L'Heureux ..... 52/743

FOREIGN PATENT DOCUMENTS 2240325 3/1975 France ..... 52/309.12
2307929 11/1976 France ..... 52/309.12

*Primary Examiner*—J. Karl Bell
*Attorney, Agent, or Firm*—Berman, Aisenberg & Platt

[57] ABSTRACT

When masonry or wooden walls are insulated with hard-foam-slab insulation covered with plaster or mortar, reinforcement of the plaster or mortar can be omitted without incurring cracking if (a) the slabs are grooved, (b) the size and number of slab grooves have defined minimal values, depending on slab thickness, (c) the slabs have a residual shrinkage of at least 0.1 percent, (d) the plaster or mortar has a maximum plastic-resin content of 2.5 percent by weight and (e) the slab weight per cubic meter is, optionally, less than 20 kg per cubic meter.

19 Claims, 3 Drawing Figures

THERMAL INSULATION FOR BUILDINGS

RELATED APPLICATION

This application is closely related to an application Ser. No. 20,509 directed to INSULATING-SLABS AND THEIR USE of the same inventor which is being filed on the same day or shortly before the present application. The entire disclosure of the related application, based on the West German Application No. P 28 50 861.4 filed Nov. 24, 1978, is incorporated herein by reference.

TECHNICAL FIELD

Insulating-slab elements are used in the construction of, e.g., insulated-plaster facades for buildings.

BACKGROUND

Throughout the world there is an ever-increasing interest in thermal insulation for buildings. One form of such insulation involves securing foamed-plastic insulating slabs or plates, such as those of foamed polystyrene, to outer surfaces of walls to be insulated. This is conveniently accomplished with mineral plaster or mortar which ordinarily contains at least 5 percent by weight of plastic resin. The outside of the slabs is then covered with a similar plaster or mortar which is suitably reinforced by, e.g., an embedded glass-fiber web, animal hair, cocoa, sisal and/or synthetic fibers.

Some difficulty is encountered because the hard-foam slabs are subject to a material degree of shrinkage over an extended period of time, i.e., as residual foaming agent and solvent emanate therefrom. The resulting contraction is more than and in excess of the maximum possible thermal contraction which, in turn, differs from the thermal contraction or expansion of the covering plaster or mortar. Both the shrinkage and the differences in thermal coefficients increase the expectation of cracks and subsequent deterioration of the covering plaster or mortar.

In an attempt to minimize this problem, such slabs or plates are usually stored before use for an extended period of time, i.e., until a residual shrinkage of not more than 0.2 percent (2 millimeter per meter) is expected. Even with the use of slabs or plates having a thickness between one inch (2.54 cm) and two inches (5.08 cm), cracking or blistering of the outer plaster or mortar could not always be prevented. The problem increased with increased thicknesses of the hard-foam slab or plate.

By using plaster or mortar with a high resin content, the resulting plaster or mortar is elastic and thus has less tendency to crack. Unfortunately, the increase in resin content also makes the plaster or mortar soft. Whereas elasticity is a welcome characteristic, softness is not. Softness is actually highly undesirable for the outer surface of a building. Moreover, plastic resins or similar adhesives increase the water-vapor diffusion-resistance factor of plaster or mortar. When such factor is too high, moisture accumulates in the hard-foam slabs or plates, and this eventually leads to their destruction. However, addition of some resin is highly desirable since pure mineral plaster or mortar does not sufficiently adhere to the surface of hard-foam slabs or plates.

INVENTION

By using grooved plates, an outer plaster or mortar with a plastic-resin content of less than 3 percent by weight and newly-manufactured slabs or plates or those with a residual shrinkage of at least 0.1 percent, a system was designed to work with hard-foam slabs or plates having thicknesses up to 5 inches (12.7 cm). Stresses created by slab or plate shrinkage were used to "clamp" the slabs or plates to the plaster or mortar, especially with the assistance of plaster-filled grooves. To achieve an uninterrupted "clamping" effect requires forces which are continually larger than those created by thermal expansion and contraction.

The limitation of the plastic-resin content in the plaster or mortar is necessitated to limit the water-vapor diffusion-resistance factor.

DETAILS

Figure 1:
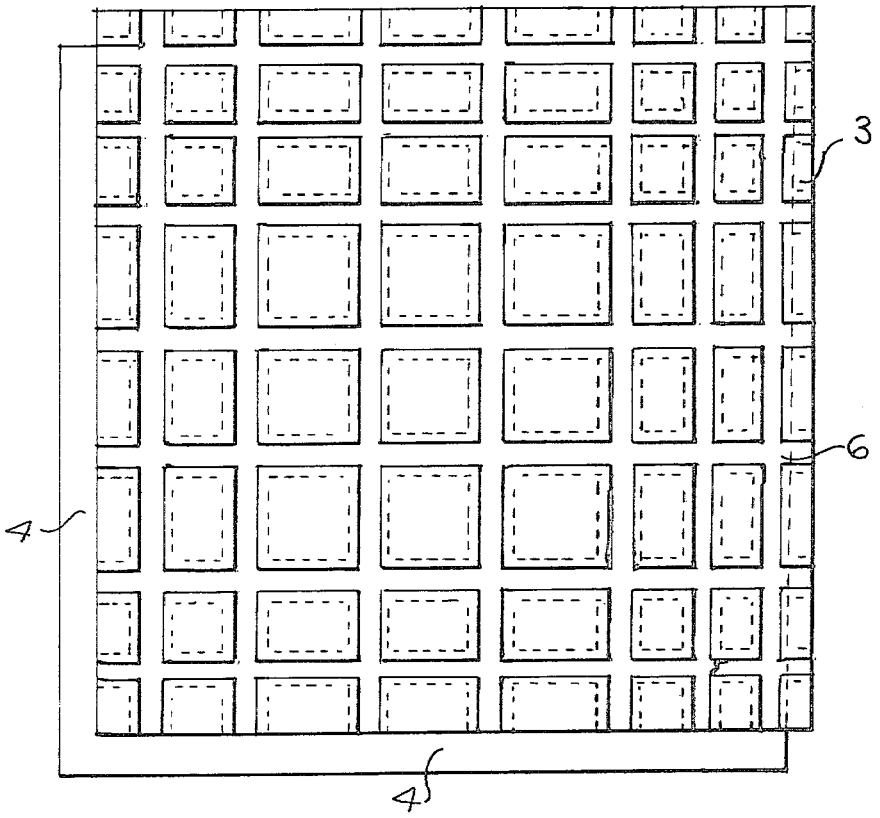
FIG. 1 is a plan view of a grooved plate.
Figure 2:
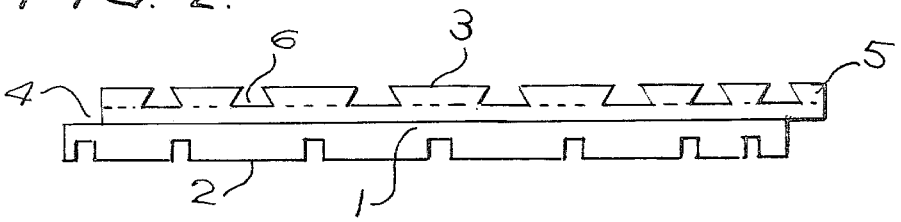
FIG. 2 is an end view of the plate of FIG. 1.
Figure 3:
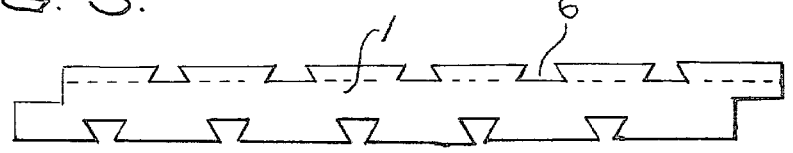
FIG. 3 is an end view of a modification of the plate of FIG. 1.

Prior to this time, reinforcement of the plaster or mortar coating applied on the outer side of the hard-foam slabs or plates was regarded as essential, but such reinforcement can now be omitted if the following conditions are satisfied:

1. The size and number of grooves (in the slabs or plates) have certain minimal values, depending on slab thickness;
2. The residual shrinkage of the slabs or plates is limited to a value between 1 and 4 mm/m, depending on slab thickness;
3. The maximum content of plastic resin is 2.5 percent by weight;
4. The slab or plate weight per cubic meter is less than 20 kg/m$^3$, which was previously considered the minimum.

Naturally, satisfactory products are prepared when the weight per cubic meter of the hard-foam plastic is in excess of 20 kg/m$^3$ and the plaster or mortar is suitably reinforced. To avoid the need for glass-fiber-web or other reinforcement of the plaster or mortar, a delicate balance is maintained between the enumerated conditions. A suitable relationship between the size of grooves, their separation and the residual shrinkage of slabs or plates of different thicknesses is exemplified in Table I.

TABLE I

| Slab or Plate Thickness (mm) | Distance between Grooves (mm) | Groove cross-section width (mm) | depth (mm) | Residual Shrinkage (mm/m) |
|---|---|---|---|---|
| 30 | 150 | 3 | 6 | 1.0 to 4.0 |
| 40 | 120 | 4 | 6 | 1.0 to 4.0 |
| 50 | 110 | 5 | 6 | 1.0 to 3.5 |
| 75 | 100 | 6 | 7 | 1.0 to 3.0 |
| 100 | 90 | 7 | 7 | 1.0 to 3.0 |
| 125 | 85 | 8 | 7 | 1.0 to 2.5 |
| 150 | 80 | 9 | 8 | 1.0 to 2.5 |

Illustrative of the plastic resins that are suitable for incorporation in the plaster or mortar coating placed on the hard-foam slabs or plates are methyl cellulose, homopolymers and copolymers of acrylic acid and methacrylic acid, e.g. styrol acrylates, and vinyl acetates. Such resins are used in a form in which they are dispersed in water. They are used individually or in any combination.

Plaster or mortar containing such synthetic resins in amounts of less than three percent by weight have a water-vapor-diffusion-resistance factor ($\mu$) within the range of about 15–25, whereas a higher percentage of these resins or the same percentage of other resins can result in corresponding factors in the range of from 100 to 500.

This does not mean that such other resins are precluded from use in this invention. The noted difficulty is overcome, e.g., by incorporating foamed mineral particles, e.g. perlite (foamed volcanic glass), in the plaster or mortar. Such incorporating results in decreasing the water-vapor-diffusion-resistance factor.

The "clamping" effect between plaster or mortar and slab or plate is that which insures a mutual hold. The plaster has to hold the slab, overcoming the stresses created by residual shrinkage. On the other hand, the slab has to provide a good hold for the plaster. When the residual shrinkage exceeds a certain threshold amount, the slab can be destroyed. However, without shrinkage, no "clamping" effect is achieved. By selecting slabs or plates with a low residual shrinkage, it is possible to use those with a low specific weight which are considerably cheaper. Such slabs or plates also have increased thermal insulating properties, but this increase is insignificant.

The composition of plaster (in weight percent of typical ingredients) for application to the outside of the slabs or plates is:

| | Example | Range |
|---|---|---|
| Cement | 12 | 5 to 20 |
| Sand | 73 | 70 to 90 |
| Chalk | 0.7 | 0 to 10 |
| Preserving agents | 0.01 | 0 to 1 |
| Methyl cellulose | 0.2 | 0 to 1 |
| Polyvinylpropionate | 2.2 | 0 to 3 |
| Water added to | 100 | 100 |

The foam-plastic, e.g. polystyrene, thermal insulation slabs or plates 1 are adapted for application to outer walls of buildings. They have a residual shrinkage capacity of from 1.0 to 4.0 millimeters per meter, a finite thickness and two major surfaces, one of which (2) is substantially planar and the other of which (3) has rim portions 4 and 5 and plural grooves 6 of measurable and substantially uniform width and depth. The ratio of slab thickness (in millimeters) to the product of groove width (in millimeters) and groove depth (in millimeters) is between 5:3 and 9:4, or advantageously between 5:3 and 2:1. The number of grooves per square meter is from 5 to 15 more than the slab thickness in centimeters.

The groove cross-section is in quadrilateral form, e.g. rectangular or dove-tail in shape. The ratio of lengths of adjacent groove sides is between 2:1 and 1:1, and the grooves are preferably closer together near the slab or plate rim than they are in the center.

Outer building walls, such as masonry walls, are insulated by adhering the slabs to the outside of the wall in such close juxtaposition that the walls are covered, the substantially planar side of each slab facing the walls. The grooved sides of the covering slabs are then plastered with a mineral plaster advantageously having a synthetic-resin-component content of less than 2.5 percent by weight and a water-vapor-diffusion-resistance factor of less than 50 and preferably within the range of about 15 to 25.

INDUSTRIAL APPLICABILITY

This invention makes it possible to insulate, e.g., masonry walls, in a manner which minimizes on-site operations and maximizes the sturdiness and lasting qualities of the provided insulation. Advantage is taken of the shrinkage properties of freshly-prepared hard-foam plastic in producing an integral reinforced insulation.

The invention and its advantages are readily understood from the preceding description. The several components, the process and the obtained product are subject to various changes without departing from the spirit and scope of the invention or sacrificing its material advantages. The components, the process and the products described herein are merely illustrative of preferred embodiments of the invention.

What is claimed is:

1. One of a plurality of foam-plastic thermal-insulating slabs having:

(a) a residual shrinkage capacity of from 1 to 4 millimeters per meter, (b) a finite thickness and (c) two major surfaces, one of which has rim portions and plural grooves of measurable and substantially uniform width and depth, the ratio of the slab thickness in millimeters to the product of the groove width in millimeters and the groove depth in millimeters being between 5:3 and 9:4, and being adapted for application to an outer wall of a building in juxtaposition to other similar slabs and for being secured to such similar slabs by a common unreinforced plaster coating covering their respective grooved surfaces and filling the grooves therein.

2. A polystyrene-foam slab according to claim 1.

3. A slab according to claim 1 having a weight of less than 20 kilograms per cubic meter.

4. A slab according to claim 3 in which the number of grooves per square meter is from 5 to 15 more than the thickness of the slab in centimeters.

5. A slab according to claim 4 in which the groove width is at least 3 millimeters.

6. A slab according to claim 5 wherein the grooves have a quadrilateral cross-section with a ratio of adjacent sides between 2:1 and 1:1.

7. A slab according to claim 6 wherein the quadrilateral cross-section is rectangular.

8. A slab according to claim 6 wherein the quadrilateral cross-section is a dove-tail cross-section.

9. A slab according to claim 3 wherein adjacent grooves are closer together at the rim portions.

10. A slab according to claim 3 wherein the ratio of the slab thickness in millimeters to the product of the groove width in millimeters and the groove depth in millimeters is between 5:3 and 2:1.

11. A slab according to claim 3 wherein the slab thickness, the average distance between grooves, the groove width, the groove depth and the residual shrinkage are within the ambit of the values presented in the following table:

| Slab or Plate Thickness (mm) | Average Distance between Grooves (mm) | Groove cross-section width depth (mm) (mm) | Residual Shrinkage (mm/m) |
|---|---|---|---|
| 30 | 150 | 3 × 6 | 1 to 4 |
| 40 | 120 | 4 × 6 | 1 to 4 |
| 50 | 110 | 5 × 6 | 1 to 3.5 |
| 75 | 100 | 6 × 7 | 1 to 3 |
| 100 | 90 | 7 × 7 | 1 to 3 |
| 125 | 85 | 8 × 7 | 1 to 2.5 |
| 150 | 80 | 9 × 8 | 1 to 2.5 |

12. Thermal insulation for an outer wall of a building comprising a plurality of slabs according to claim 1 having one of their respective sides adhered to the wall and having their opposite and grooved sides covered with a common layer of synthetic-resin-component containing mineral plaster having a water-vapor-diffusion-resistance factor of less than 50.

13. Thermal insulation according to claim 12 wherein the mineral plaster is unreinforced plaster and the slabs have a weight of less than 20 kilograms per cubic meter.

14. Thermal insulation according to claim 13 wherein the slabs are foamed-polystyrene slabs.

15. Thermal insulation according to claim 13 wherein the plaster comprises, in admixture, foamed mineral particles.

16. Thermal insulation according to claim 12 wherein the slabs are similarly grooved on both of their opposite sides.

17. A slab according to claim 1 having a maximum residual shrinkage value between 1 and 4 millimeters per meter, which depends depending on slab thickness.

18. Thermal insulation for an outer wall of a building comprising a plurality of slabs having a weight of less than 20 kg/m$^3$, having one of their respective sides adhered to the wall and having their opposite and grooved sides covered with a common layer of synthetic-resin-component containing unreinforced mineral plaster having a water-vapor-diffusion-resistance factor of less than 50; the synthetic-resin-component content of the mineral plaster being less than 2.5 percent by weight and each slab being one of a plurality of foam-plastic thermal-insulating slabs having:

(a) a residual shrinkage capacity of from 1 to 4 millimeters per meter, (b) a finite thickness and (c) two major surfaces, one of which has rim portions and plural grooves of measurable and substantially uniform width and depth, the ratio of the slab thickness in millimeters to the product of the groove width in millimeters and the groove depth in millimeters being between 5:3 and 9:4, and being in juxtaposition to other similar slabs to which it is secured by a common plaster coating covering their respective grooved surfaces and filling the grooves therein.

19. Thermal insulation for an outer wall of a building comprising a plurality of slabs having a weight of less than 20 kg/m$^3$, having one of their respective sides adhered to the wall and having their opposite and grooved sides covered with a common layer of synthetic-resin-component containing unreinforced mineral plaster having a water-vapor diffusion-resistance factor within the range of about 15 to 25; each slab being one of a plurality of foam-plastic thermal-insulating slabs having:

(a) a residual shrinkage capacity of from 1 to 4 millimeters per meter, (b) a finite thickness and (c) two major surfaces, one of which has rim portions and plural grooves of measurable and substantially uniform width and depth, the ratio of the slab thickness in millimeters to the product of the groove width in millimeters and the groove depth in millimeters being between 5:3 and 9:4, and being in juxtaposition to other similar slabs to which it is secured by a common plaster coating covering their respective grooved surfaces and filling the grooves therein.

* * * * *